US007744424B2

(12) United States Patent
Hadir et al.

(10) Patent No.: US 7,744,424 B2
(45) Date of Patent: Jun. 29, 2010

(54) EXPANSION CONNECTION MODULE FOR CONNECTING TO AT LEAST TWO COIL CONNECTORS OF AN ELECTROMAGNETIC SWITCHING DEVICE, IN PARTICULAR A CONTACTOR

(75) Inventors: Khalil Hadir, Ebermannsdorf (DE); Manuela Lüftl, Ruhstoff a.d. Rott (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/385,040

(22) Filed: Mar. 30, 2009

(65) Prior Publication Data

US 2009/0247019 A1 Oct. 1, 2009

(30) Foreign Application Priority Data

Apr. 1, 2008 (EP) ..... 08400026

(51) Int. Cl.
*H01R 33/94* (2006.01)

(52) U.S. Cl. ..... 439/638; 439/810

(58) Field of Classification Search ..... 439/76.2, 439/638, 801, 810–814; 335/132, 202
See application file for complete search history.

(56) References Cited

U.S. PATENT DOCUMENTS 6,285,271 B1 * 9/2001 Bauer et al. ..... 335/132

FOREIGN PATENT DOCUMENTS

| | | | |
|---|---|---|---|
| DE | 2034775 | A1 | 1/1972 |
| DE | 3423854 | A1 | 1/1986 |
| WO | WO 2006084421 | A1 | 8/2006 |

* cited by examiner

*Primary Examiner*—Khiem Nguyen
(74) *Attorney, Agent, or Firm*—Harness, Dickey & Pierce, P.L.C.

(57) ABSTRACT

An expansion connection module is disclosed for connecting to at least two coil connectors of an electromagnetic switching device, in particular a contactor. In at least one embodiment, the expansion connection module includes a housing; at least one fastening device for fixing the expansion connection module to the electromagnetic switching device or to a switchgear unit positioned adjacent to the electromagnetic switching device; at least two connection openings and at least two terminal blocks associated with the at least two connection openings for the purpose of connecting voltage supply lines; and at least two flexible leads for electrically connecting the terminal blocks of the expansion connection module to the at least two coil connectors of the electromagnetic switching device.

14 Claims, 4 Drawing Sheets

EXPANSION CONNECTION MODULE FOR CONNECTING TO AT LEAST TWO COIL CONNECTORS OF AN ELECTROMAGNETIC SWITCHING DEVICE, IN PARTICULAR A CONTACTOR

PRIORITY STATEMENT

The present application hereby claims priority under 35 U.S.C. §119 on European patent application number EP08400026 filed Apr. 1, 2008, the entire contents of which is hereby incorporated herein by reference.

FIELD

At least one embodiment of the present invention generally relates to an expansion connection module for connecting to at least two coil connectors of an electromagnetic switching device, in particular a contactor.

BACKGROUND

In order to activate an electromagnetic switching device, in particular a contactor, a voltage must be applied to the drive, for example the contactor drive. For that purpose it is known to provide at least two coil connector terminals fixedly attached to the housing of the electromagnetic switching device. Since contactors, for example, can be combined in different ways with other switching devices, it can happen that the coil connector terminals are poorly accessible. Sometimes said coil connector terminals become hidden, so they need to be provided again at other points on the contactor housing. This implies an expansion of the coil connectors inside the contactor, though this is complicated, time-consuming and cost-intensive and means that the contactor can consequently be used only for a specific purpose.

the coil connector terminals are arranged next to the connector terminals for the main circuit or auxiliary circuit so that the coil connector can be accessed from the front, at least one coil connector terminal is often difficult to access when the switching device is combined with other switching devices. As well as these devices, in which the coil connector terminals lie in a connecting plane with the prime and auxiliary conductor terminals, electromagnetic switching devices are known in which the coil connector terminals are arranged under the prime conductor terminals. With switching devices of said kind, accessibility is made more difficult still due to the even more complex layout, in particular when the prime conductor is connected. When additional switching devices, for example a circuit-breaker and/or an overload relay, are included in the configuration, the coil connectors are scarcely still accessible in these cases.

SUMMARY

In at least one embodiment of the invention, the coil connectors of an electromagnetic switching device are flexible and this makes them easily accessible. In a particular embodiment, the fixed coil connectors are expandable in a flexible manner.

In at least one embodiment of the invention, an expansion connection module is disclosed for connecting to at least two coil connectors of an electromagnetic switching device, in particular a contactor, said module having a housing, at least one fastening device for fixing the expansion connection module to the electromagnetic switching device or to a switchgear unit positioned adjacent to the electromagnetic switching device, at least two connection openings and at least two terminal blocks associated with the at least two connection openings for the purpose of connecting voltage supply lines, as well as at least two flexible leads for electrically connecting the terminal block of the expansion connection module to the at least two coil connectors of the electromagnetic switching device.

The core of at least one embodiment of the invention resides in the expansion connection module representing a kind of adapter by which the coil connectors of the electromagnetic switching device are extended or, as the case may be, placed at more easily accessible points. The expansion connection module can be easily installed on the electromagnetic switching device with the aid of the at least one fastening device or removed from it. The fastening devices are advantageously embodied for fixing the expansion connection module by a force fit to the electromagnetic switching device or to a further switchgear unit positioned adjacent to the electromagnetic switching device. The length of the flexible leads can be embodied to be different and variable. The flexible leads are easily bendable electrical conductors. Thanks to the flexibility the flexible leads can be very easily and quickly connected to the existing coil connectors of the electromagnetic switching device.

The expansion connection module can also be embodied for connecting to more than two coil connectors of an electromagnetic switching device. The expansion connection module has a housing in which the connection openings and the terminal blocks associated with the connection openings are disposed. The terminal blocks are embodied for receiving voltage supply lines. In this case a voltage supply line can be fed through a connection opening in each case to an terminal block and firmly fixed in the housing of the expansion connection module by means of the respective terminal block such that the electromagnetic switching device can be supplied with a voltage by way of the expansion connection module.

The flexible leads allow the flexible attachment of the expansion connection module to the electromagnetic switching device. After the expansion connection module has been fixed to the electromagnetic switching device or to a switchgear unit positioned adjacent to the electromagnetic switching device, the flexible leads are embodied as sufficiently long to reach as far as the coil connectors of the electromagnetic switching device in order to enable the drive of the electromagnetic switching device to be supplied with electrical power by way of the expansion connection module.

The advantage of the expansion connection module is that after the expansion connection module has been secured to the electromagnetic switching device or to the switchgear unit positioned adjacent to the electromagnetic switching device, the connection openings and the terminal blocks of the expansion connection module are more easily accessible and consequently a fast connection of the electromagnetic switching device to a voltage supply is made possible. In particular coil connectors of an electromagnetic switching device that are difficult to access can be made easily accessible by the rerouting of the connections to the expansion connection module.

A further advantage of the expansion connection module lies in the fact that the electromagnetic switching devices do not have to include at least one integrated device of rerouting the coil connector terminals, which would be complicated, time-consuming and cost-intensive. The expansion connection module itself is a simple and economical add-on part by means of which it becomes possible to expand the coil connectors of an electromagnetic switching device, in particular a contactor. It is left to the discretion of the customer to use the electromagnetic switching device with or without extending the coil connectors, that is to say with or without the expansion connection module. The need to make use of the expansion connection module often only arises when the respective switching devices are combined in order to form a switching device unit or, as the case may be, a load feeder.

An expansion connection module is preferred in which the terminal blocks are embodied as screw-type terminals or as spring-loaded terminals. Screw-type terminals and spring-loaded terminals have both been well-known for a long time in cable connection technology. The terminals serve for detachably connecting electrical conductors, in this case the voltage supply lines. Particularly preferably, what are termed cage clamp terminals are used. The mechanical fixing of the respective voltage supply line is easily accomplished by means of a screw or a spring. In the terminal blocks, the voltage supply lines are connected to an electrical conductor inside the expansion connection module and thereby connected in an electrically conducting manner with the flexible leads of the expansion connection module.

A friction-locked fixing of the expansion connection module to the electromagnetic switching device or to the switchgear unit positioned adjacent to the electromagnetic switching device can be embodied in a variety of ways. Thus, for example, screw-type fastenings are possible. Positively bonded material connections, such as adhesive bonds, are also possible. What is preferred, however, is an expansion connection module in which the fastening means of the expansion connection module have snap-action connection elements. Snap-action connection elements allow fast assembly and disassembly of the expansion connection module on the electromagnetic switching device or an adjacent switchgear unit. Advantageously, the expansion connection module has snap-in hooks which engage in a detachable manner in corresponding receptacles, i.e. undercuts, depressions, etc., of the switching device or the adjacent switchgear unit and thereby fix the expansion connection module in place.

Preferably the expansion connection module can also be fixable in a positive-locking manner to the electromagnetic switching device or to the switchgear unit positioned adjacent to the electromagnetic switching device. This creates a particularly good fixing of the expansion connection module.

A further advantageous embodiment of the expansion connection module provides that at least two connection openings of the expansion connection module are arranged on one side of the expansion connection module. The connection openings can be provided on different sides of the expansion connection module. Depending on the position of the coil connectors on the electromagnetic switching device it can sometimes be advantageous for the connection openings to be arranged on different sides of the expansion connection module or possibly on a single side.

It is preferably also provided that the housing of the expansion connection module has a cover. This enables the terminal blocks to be easily accessed for possible repairs or similar.

An expansion connection module having spring-loaded connector terminals has at least one feedthrough through which an operating tool can be passed in order to operate the spring-loaded terminal. In an embodiment of the expansion connection module it is possible for two or more spring-loaded terminals to be accessed through a single feedthrough. Preferred, however, is an expansion connection module which has at least two feedthroughs for opening the terminal blocks, in particular the at least two spring-loaded terminals, by means of an operating tool which can be passed through. In particular each connection opening or, as the case may be, each terminal block is assigned a separate feedthrough.

The connection openings can have different shapes and sizes. This is possible in particular when the expansion connection module has a plurality of connectors. This also enables a plurality of electromagnetic switching devices to be connected to one expansion connection module. In particular when only one electromagnetic switching device is to be expanded by way of the expansion connection module, it is advantageous if the cross-section of the connection openings is the same.

The flexible leads are brought out of the interior of the expansion connection module and for the purpose of the electrical connection can be secured by way of a simple wiring arrangement to the coil connectors of the electromagnetic switching device. In this case it can be desirable for the flexible leads to be routed along a specific path. This can be implemented by running the flexible leads in special guides. The guides are preferably simple tubes or channels in which at least a partial section of a flexible lead can be routed.

The flexible leads of the expansion connection module are preferably passed through openings in the housing, in particular in the cover of the housing.

Also preferred is an expansion connection module in which the expansion connection module has at least one securing device for securing a further switching device and/or another accessory part. The securing device enables the simple fixing of a further switching device and/or a further accessory part. The securing device can be embodied for friction locking and/or material bonding. The securing device is advantageously embodied as snap-action connections. In this case the securing device can be embodied as a snap-in hook or as a receptacle element, for example as an undercut or opening, for receiving a snap-in hook of an accessory part. Securing devices of said kind are preferably provided on different free sides of the expansion connection module. Said securing devices make the expansion connection module even more flexible and increase the application variants of the expansion connection module.

By way of the expansion connection module which constitutes an accessory part an expansion of the coil connectors A1, A2 on a contactor can be implemented with a simple accessory part.

BRIEF DESCRIPTION OF THE DRAWINGS

The invention will now be explained in more detail with the aid of non-exclusive example embodiments and with reference to the accompanying drawings, in which.

DETAILED DESCRIPTION OF THE EXAMPLE EMBODIMENTS

Figure 1:
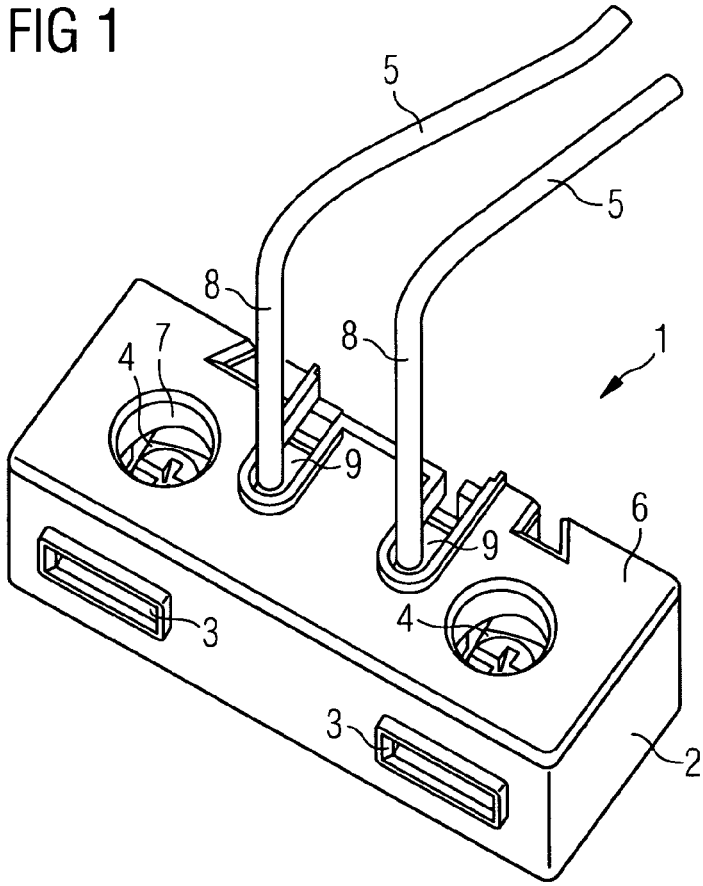
FIG. 1 shows an expansion connection module having two coil connectors embodied as screw-type terminals.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an expansion connection module 1 having two coil connectors 4 embodied as screw-type terminals. The expansion connection module 1 has a housing 2 and a cover 6 closing the housing 2. Provided in the cover 6 are two feedthroughs 7 through which screws of the terminal blocks 4 can be screwed in. Two connection openings 3 for receiving supply voltage lines are provided on one side of the housing 2. The cover 6 has openings 9 through which the flexible leads 5 are brought out from the expansion connection module 1. Said flexible leads 5 serve for electrically connecting the expansion connection module 1 to coil connectors of an electromagnetic switching device (not shown). The ends of the flexible leads 5 facing toward the expansion connection module 1 are routed in flexible lead guides 8. The flexible lead guides 8 are not absolutely essential, but serve for routing the flexible lead 5 in a directed manner.

Figure 2:
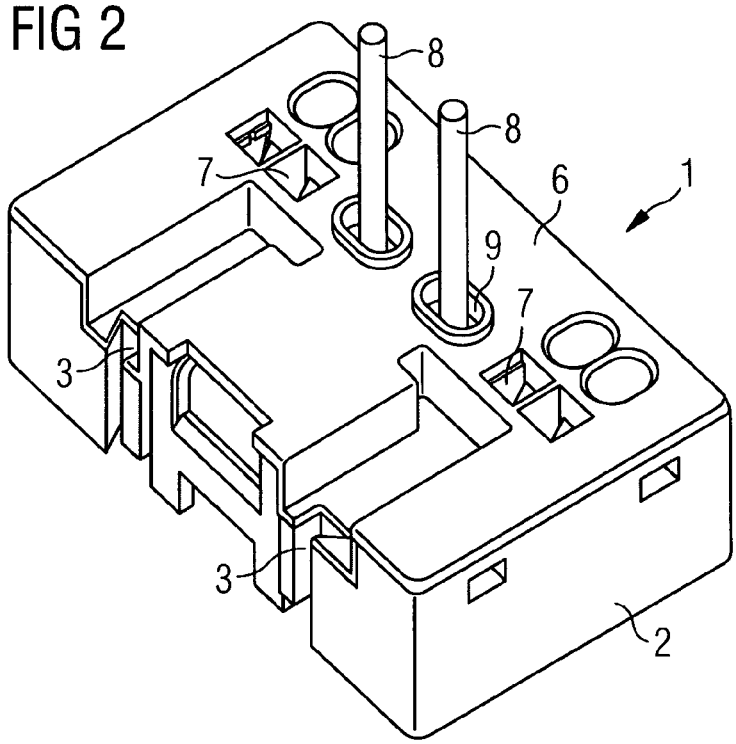
FIG. 2 shows an expansion connection module having two coil connectors embodied as spring-loaded terminals.

FIG. 2 shows an expansion connection module 1 having two coil connectors 4 embodied as spring-loaded terminals. The structure of the expansion connection module 1 roughly corresponds to the structure of the expansion connection module 1 according to FIG. 1. In this case, instead of the screw-type terminals, spring-loaded terminals are provided in the terminal blocks 4. Two connection openings 3 for receiving supply voltage lines are provided on one side of the housing 2. An operating tool can be introduced through the feedthroughs 7 in order to operate the spring-loaded terminal.

Figure 3:
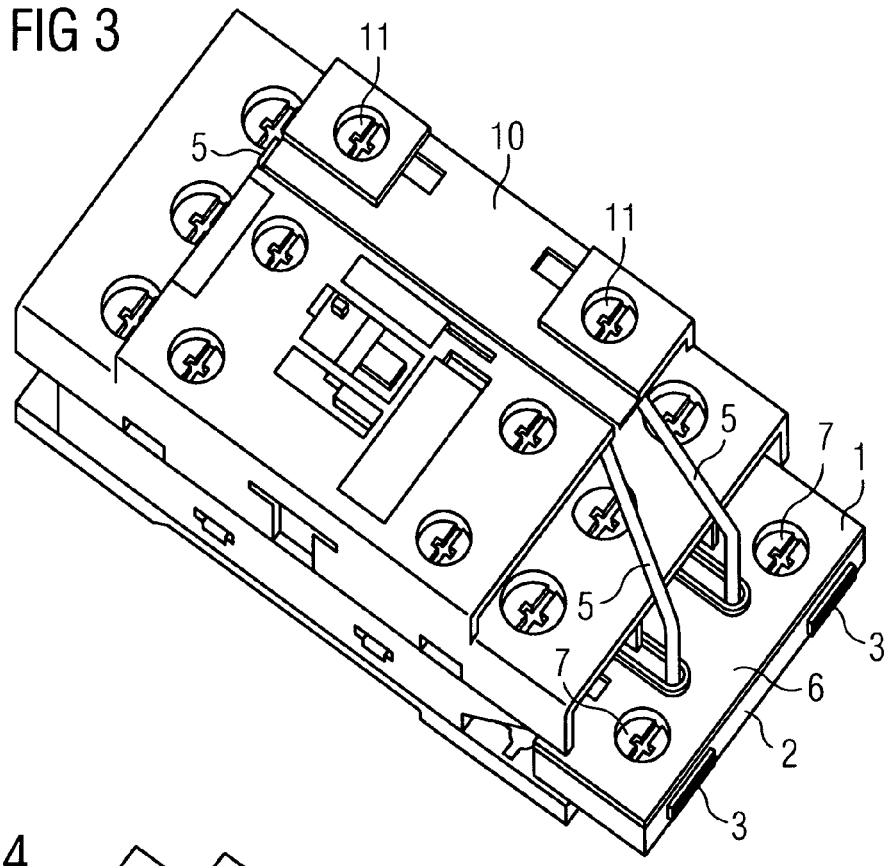
FIG. 3 shows a contactor with one expansion connection module installed.
Figure 4:
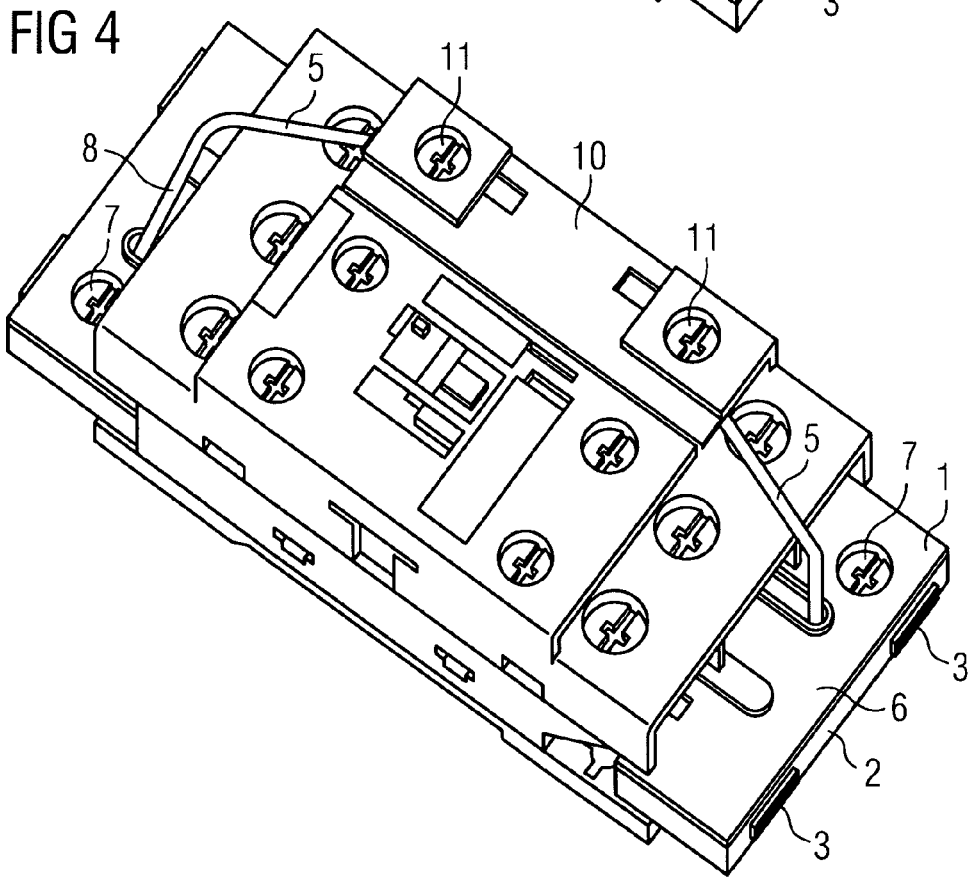
FIG. 4 shows a contactor with two expansion connection modules installed.
Figure 5:
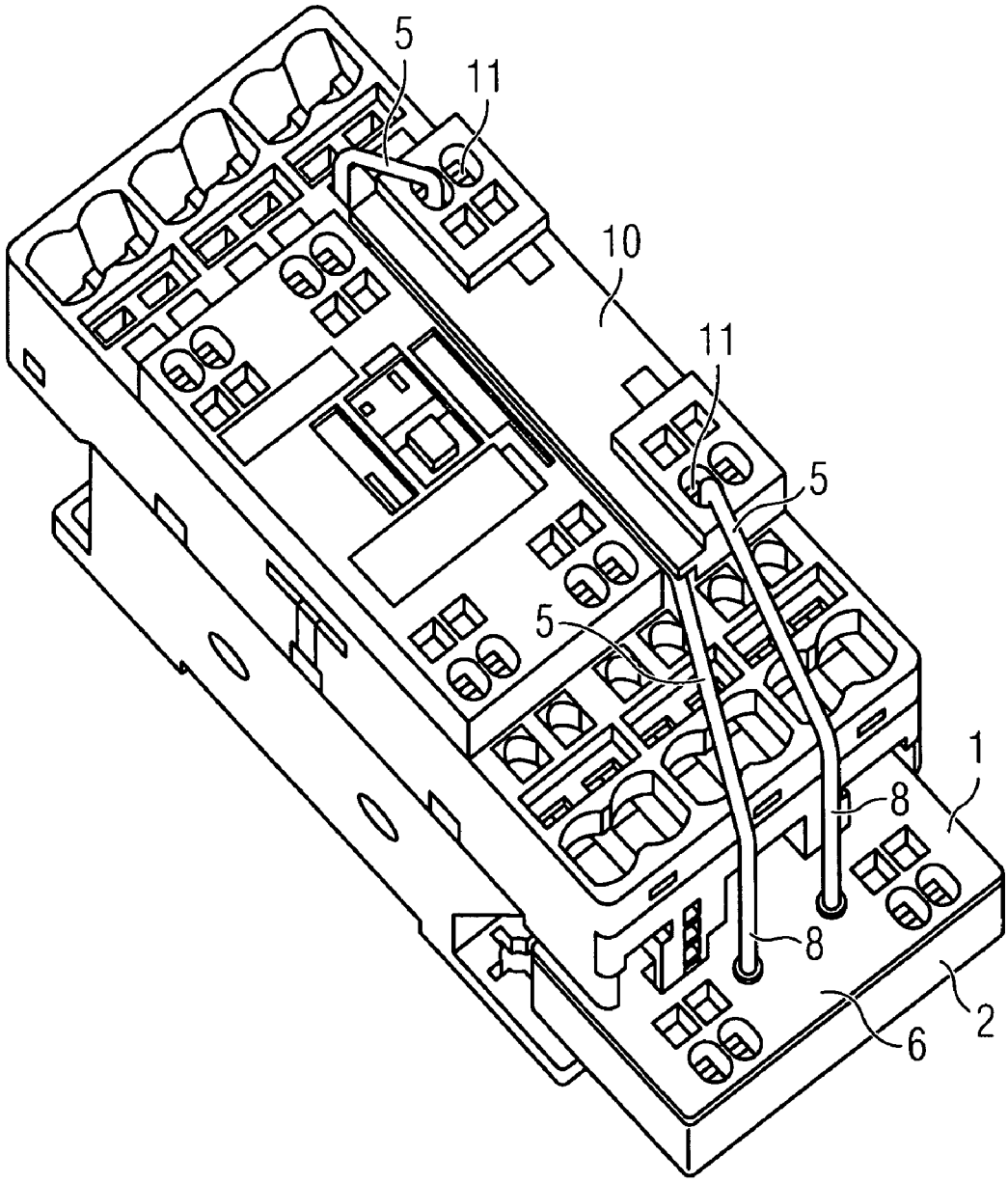
FIG. 5 shows a contactor with one expansion connection module installed.

Various combinations of expansion connection module(s) 1 and electromagnetic switching device 10 are shown in FIGS. 3 to 5.

In FIG. 3, an expansion connection module 1 having screw-type terminals as terminal blocks 4 is fixed on one side of a contactor 10. The expansion connection module 1 has two flexible leads 5, each of which is connected to a coil connector or a coil connector terminal 11 of the contactor 10. In this case one flexible lead 5 runs underneath a cover of the contactor 10 in order to reach the corresponding coil connector terminal 11.

In FIG. 4, one expansion connection module 1 is arranged on each of the two sides of a contactor 10. Each expansion connection module 1 has a flexible lead 5 which is wired to one coil connector terminal 11 of the contactor 10 in each case. The unused opening 9 in the cover 6 of the housing 2 of each expansion connection module 1 is closed by way of a sealing element.

FIG. 5 shows an expansion connection module 1 having terminal blocks 4 embodied as spring-loaded terminals. The expansion connection module 1 is detachably secured to the contactor 10 on one side of the latter. In this case, too, the coil connectors 11 of the contactor are also arranged at two different points on the front of the contactor 10. One flexible lead 5 leads to the first coil connector 11, the other flexible lead 5 runs underneath the cover of the contactor 10 to the second coil connector 11.

Figure 6:
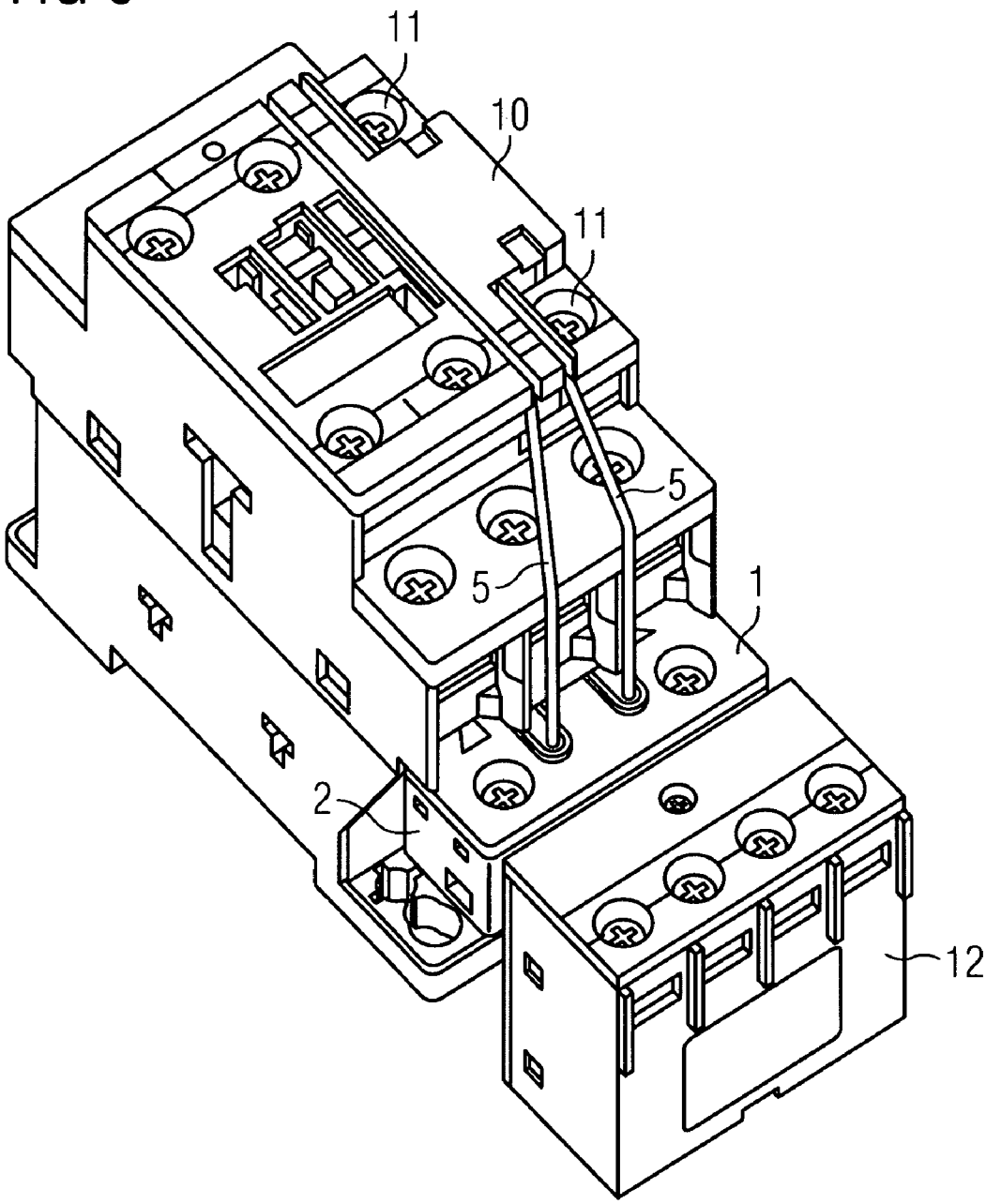
FIG. 6 shows a contactor with one expansion connection module and a further accessory part.

FIG. 6 shows an expansion connection module 1 arranged on a contactor 10. A further accessory part 12 is secured in a detachable manner, in particular by way of a snap-action connection, on the side of the expansion connection module 1 facing away from the contactor 10. The further accessory part 12 can also be an expansion connection module for example. Alternatively, a further switching device can be secured to the expansion connection module 1.

The contacting at the contactor can be established with the aid of a contact tag.

In another example embodiment variant, the expansion connection module 1 can be fixed directly in the switching cabinet or, as the case may be, to a mounting rail inside the switching cabinet.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An expansion connection module for connecting to at least two coil connectors of an electromagnetic switching device, the expansion connection module comprising:

a housing;

at least one fastening device for fixing the expansion connection module to the electromagnetic switching device or to a switchgear unit positioned adjacent to the electromagnetic switching device;

at least two connection openings;

at least two terminal blocks, associated with the at least two connection openings, for connecting voltage supply lines; and at least two flexible leads for electrically connecting the terminal blocks of the expansion connection module to coil connectors of the electromagnetic switching device, wherein a portion of the housing is configured to be inserted into the electromagnetic switching device.

2. The expansion connection module as claimed in claim 1, wherein the terminal blocks are embodied as screw-type terminals or as spring-loaded terminals.

3. The expansion connection module as claimed in claim 1, wherein the expansion connection module is fixable in a positive-locking manner to the electromagnetic switching device or to the switchgear unit positioned adjacent to the electromagnetic switching device.

4. The expansion connection module as claimed in claim 1, wherein at least two connection openings of the expansion connection module are arranged on one side of the expansion connection module.

5. The expansion connection module as claimed in claim 1, wherein the housing of the expansion connection module has a cover.

6. The expansion connection module as claimed in claim 1, wherein the expansion connection module has at least two feedthroughs for opening the terminal blocks, by way of an operating tool which can be passed through.

7. The expansion connection module as claimed in claim 1, wherein the cross-section of the connection openings is the same.

8. The expansion connection module as claimed in claim 1, wherein at least one flexible lead is routed in a flexible lead guide at the end facing toward the expansion connection module.

9. The expansion connection module as claimed in claim 1, wherein the flexible leads are fed through openings in the housing.

10. The expansion connection module as claimed in claim 1, wherein the expansion connection module has at least one securing device for fixing at least one of a further switching device and another accessory part.

11. The expansion connection module as claimed in claim 2, wherein the expansion connection module is configured to be fixed in a positive-locking manner to the electromagnetic switching device or to the switchgear unit positioned adjacent to the electromagnetic switching device.

12. The expansion connection module as claimed in claim 2, wherein at least two connection openings of the expansion connection module are arranged on one side of the expansion connection module.

13. The expansion connection module as claimed in claim 2, wherein the expansion connection module has at least two feedthroughs for the spring-loaded terminals, by way of an operating tool which can be passed through the feedthroughs.

14. The expansion connection module as claimed in claim 5, wherein the flexible leads are fed through openings in the cover of the housing.

* * * * *